US006929525B2

(12) United States Patent
Lee et al.

(10) Patent No.: US 6,929,525 B2
(45) Date of Patent: Aug. 16, 2005

(54) DECORATIVE VENT ATTACHMENT

(76) Inventors: Rong-Chun Lee, 668 Chungcheng Rd., Hsinchuang (TW), 24205; Jiang-Cai Lee, 668 Chungcheng Rd., Hsinchuang (TW), 24205

( * ) Notice: Subject to any disclaimer, the term of this patent is extended or adjusted under 35 U.S.C. 154(b) by 0 days.

(21) Appl. No.: 10/457,220

(22) Filed: Jun. 9, 2003

(65) Prior Publication Data

US 2004/0219860 A1 Nov. 4, 2004

(51) Int. Cl.[7] ..... A63H 33/40
(52) U.S. Cl. ..... 446/217; 40/412
(58) Field of Search ..... 40/412, 477, 478, 40/479; 446/201, 217, 218

(56) References Cited

U.S. PATENT DOCUMENTS 1,327,360 A * 1/1920 Smigielski ..... 446/201
2,545,801 A * 3/1951 Wrazen ..... 40/412
6,678,979 B2 * 1/2004 Lim et al. ..... 40/412

* cited by examiner

*Primary Examiner*—Harry B. Tanner
(74) *Attorney, Agent, or Firm*—Clement Cheng

(57) ABSTRACT

A swinging decorative attachment comprising a base having at least one rack and one boring allowing airflow through the base; two swinging means, both having a wheel-shaped connector on the first end of said swinging means, connecting with the edge of said base, forming a wheel gear respectively, to which two wheel gears connect each other; a fan module attached on that base; at least one gear module connecting to an axle of said fan module; and a subordinate module connecting said gear module and the second end of one said swinging mean, making said two swinging means pushed and turned mutually, forming open-closed swinging motions. In addition, fragrant materials can be used inside said base. The airflow will bring out the fragrance from said base through said bore, and to spread the fragrance among the room.

13 Claims, 8 Drawing Sheets

DECORATIVE VENT ATTACHMENT

FIELD OF INVENTION

This invention relates to an automobile vent attachment, specifically to a decorative vent attachment.

SUMMARY

This invention provides a swinging decorative attachment comprising a base having at least one rack and one boring allowing airflow through the base; two swinging means, both having a wheel-shaped connector on the first end of said swinging means, connecting with the edge of said base, forming a wheel gear respectively, to which two wheel gears connect each other; a fan module attached on that base; at least one gear module connecting to an axle of said fan module; and a subordinate module connecting said gear module and the second end of one said swinging mean, making said two swinging means pushed and turned mutually, forming open-closed swinging motions.

In addition, fragrant materials can be used inside said base. The airflow will bring out the fragrance from said base through said bore, and to spread the fragrance among the room.

OBJECTS OF THE INVENTION

The present invention has following objects and advantages:

1. This invention provides extreme power saving, smooth swinging decorative attachment by using the subordinate module pushing and turning the far side of one said swinging mean to swing both said swinging means mutually.
2. This invention not only provides the smooth swinging but also simplifies the design structure. Fragrant material can also be used around and inside said base. The airflow will bring out the fragrance from said base through said bore, and to spread the fragrance among the room.
3. In addition, this invention can further include a flexible clip plugging on the edge of said base.

DETAILED DESCRIPTION

Figure 1:
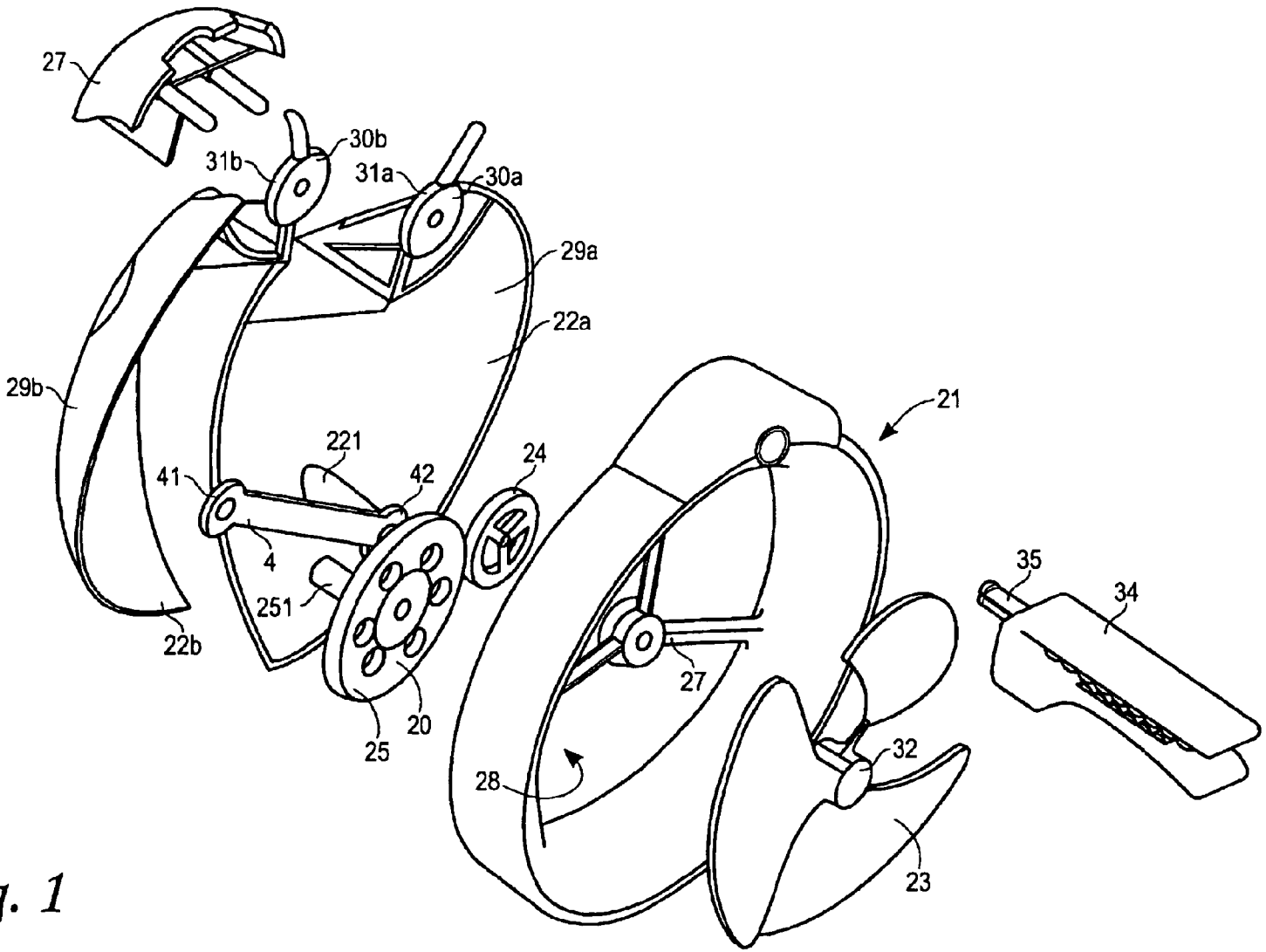
FIG. 1 is a rear exploded view of the first embodiment.
Figure 2:
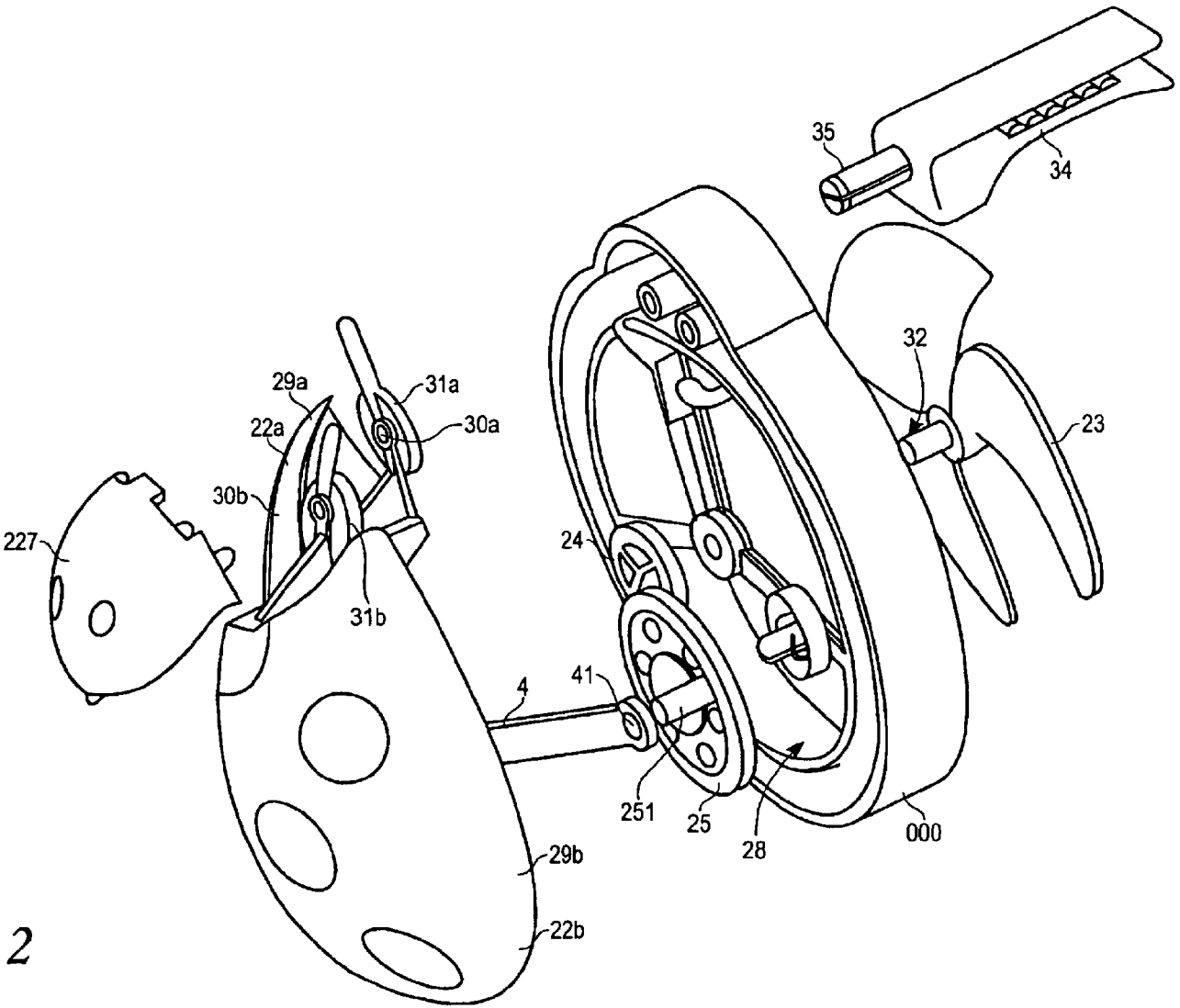
FIG. 2 is a front exploded view of the first embodiment.
Figure 3:
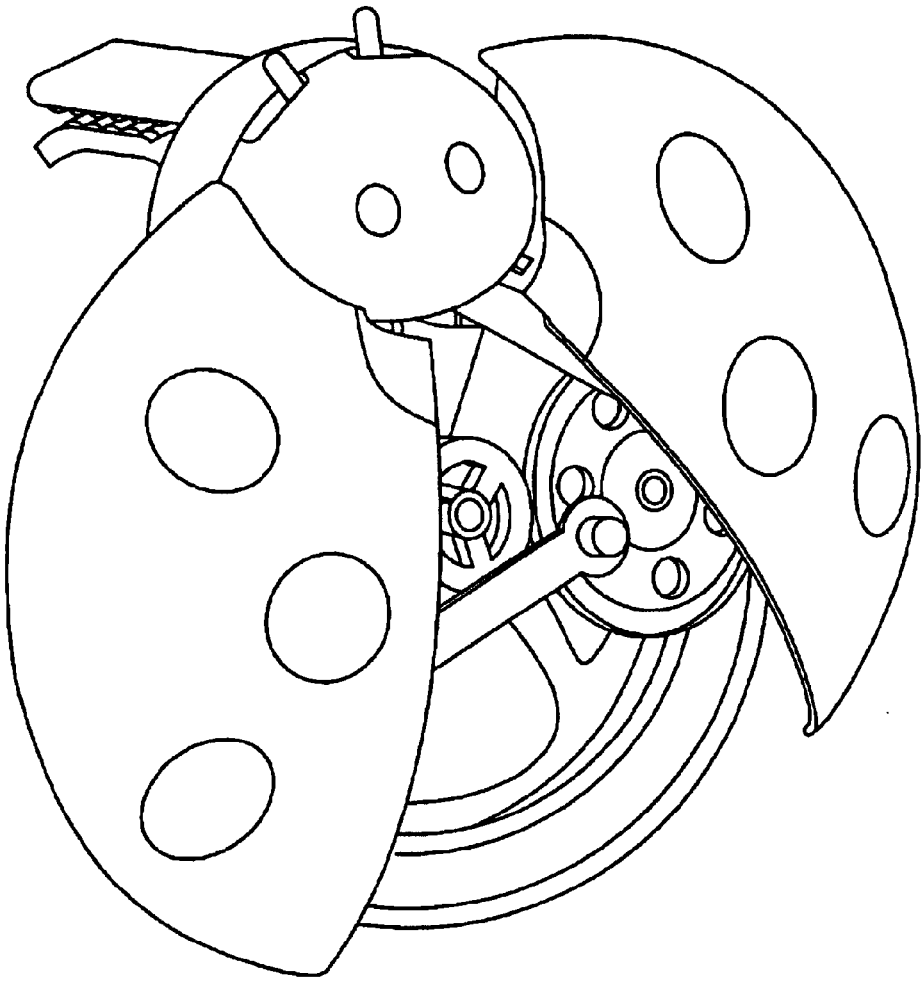
FIG. 3 is front view of the first embodiment.
Figure 4:
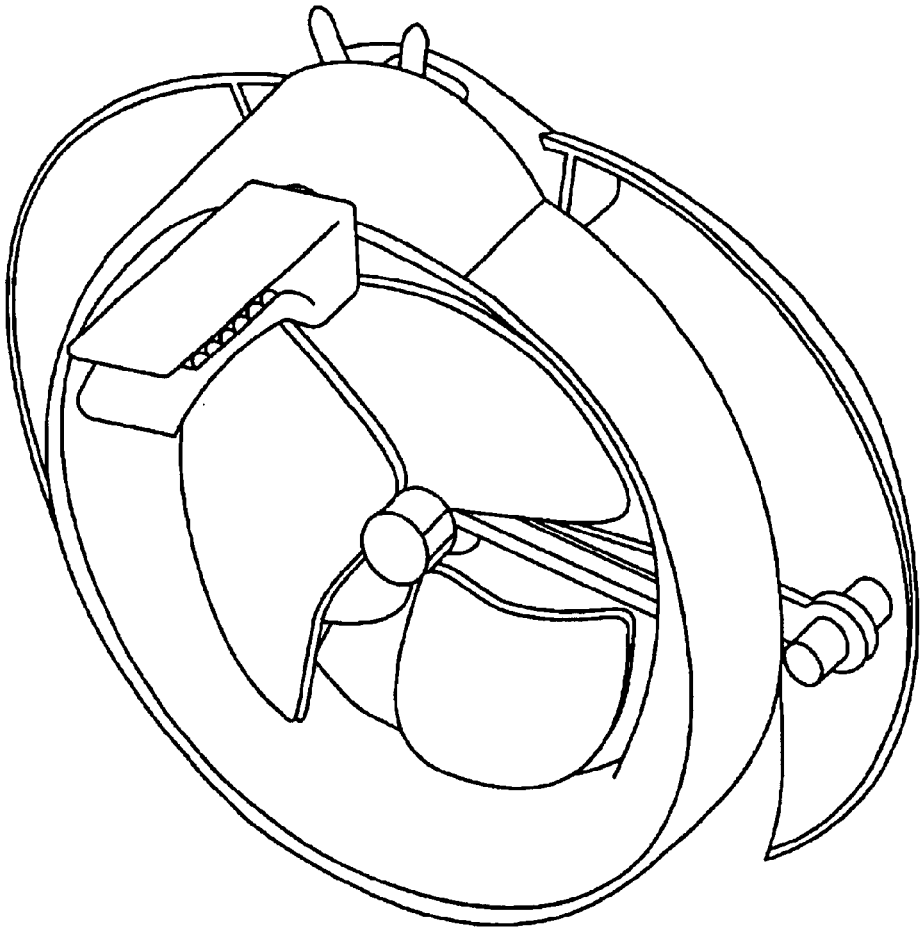
FIG. 4 is rear view of the first embodiment.
Figure 5:
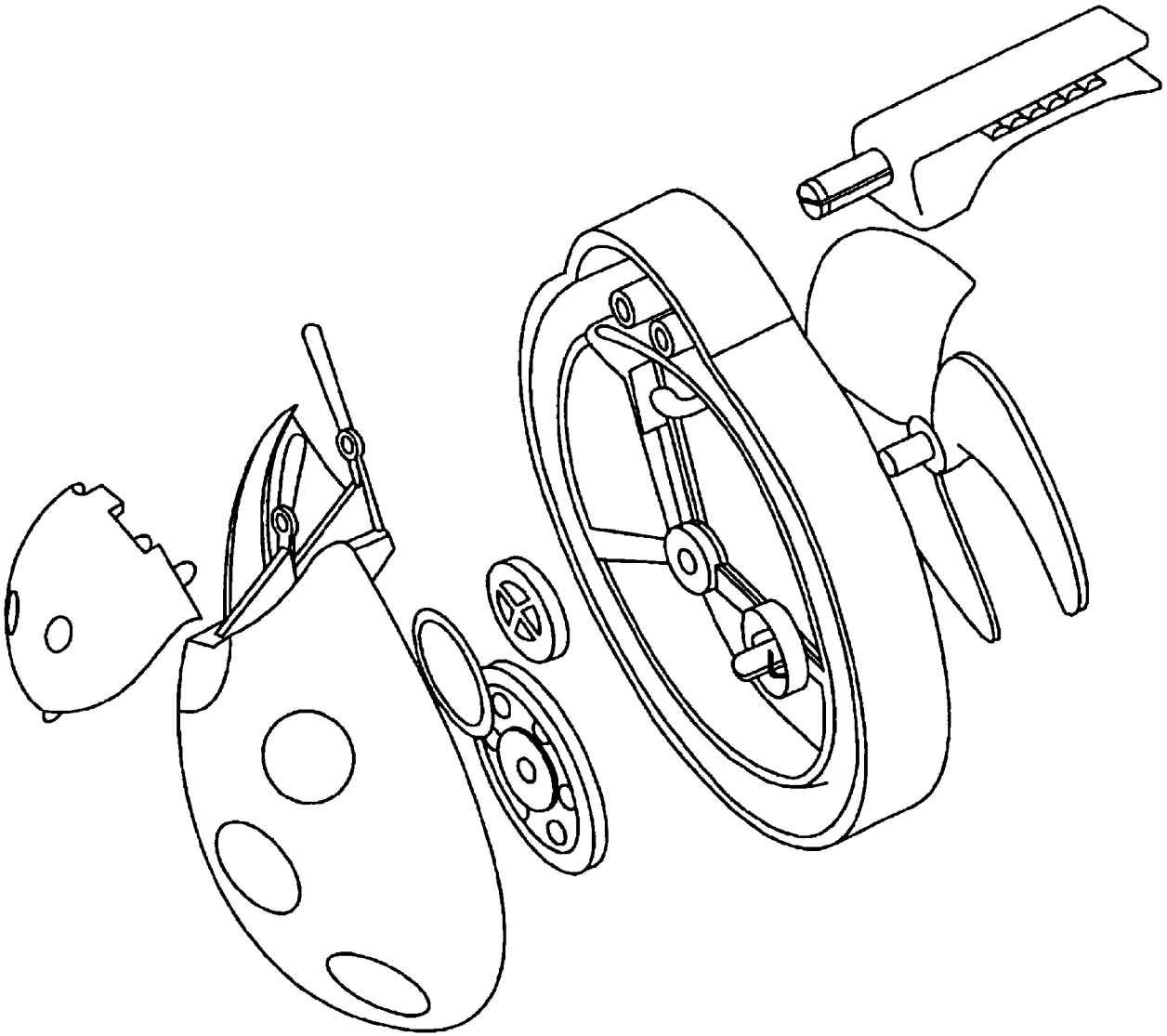
FIG. 5 is a front exploded view of the second embodiment.
Figure 6:
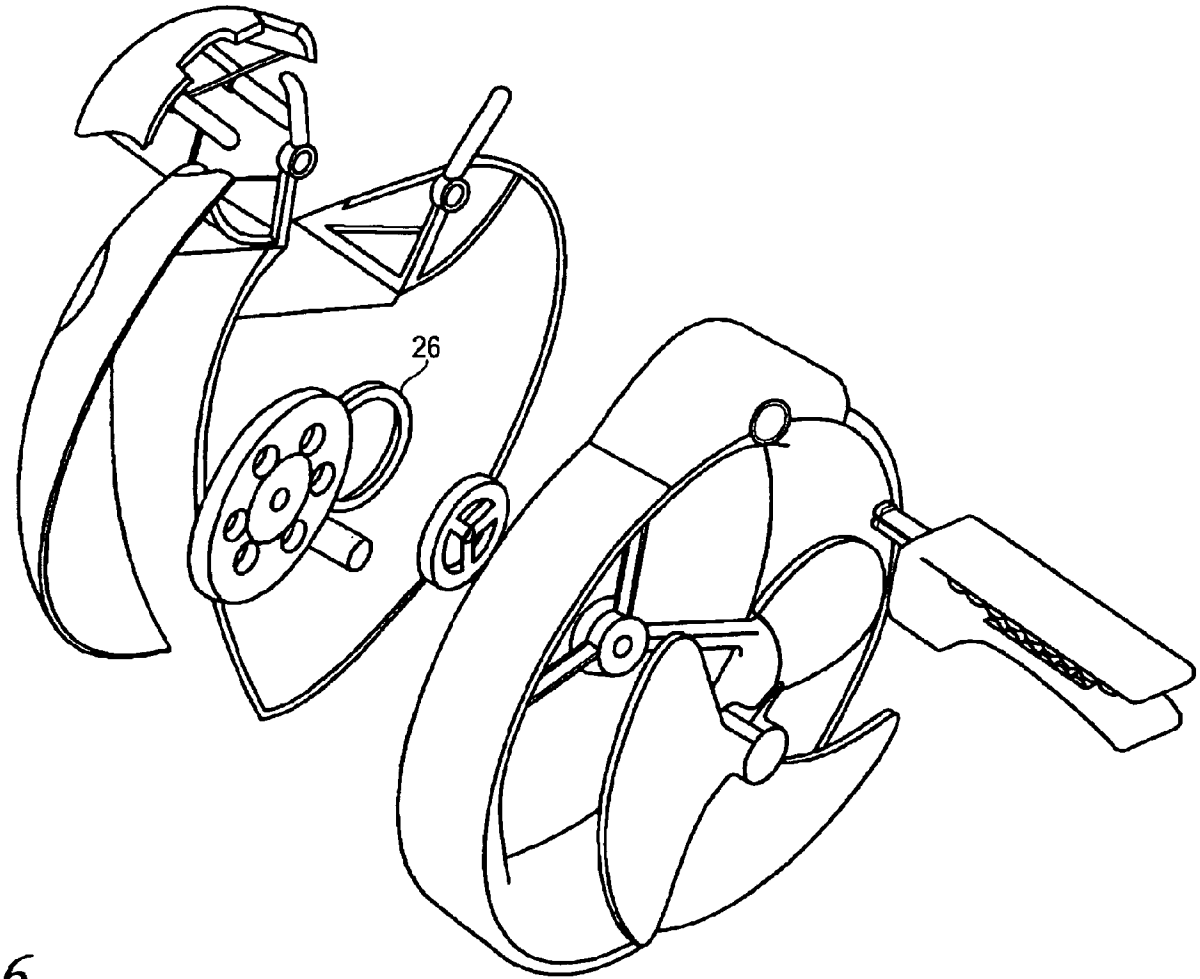
FIG. 6 is a rear exploded view of the second embodiment.
Figure 7:
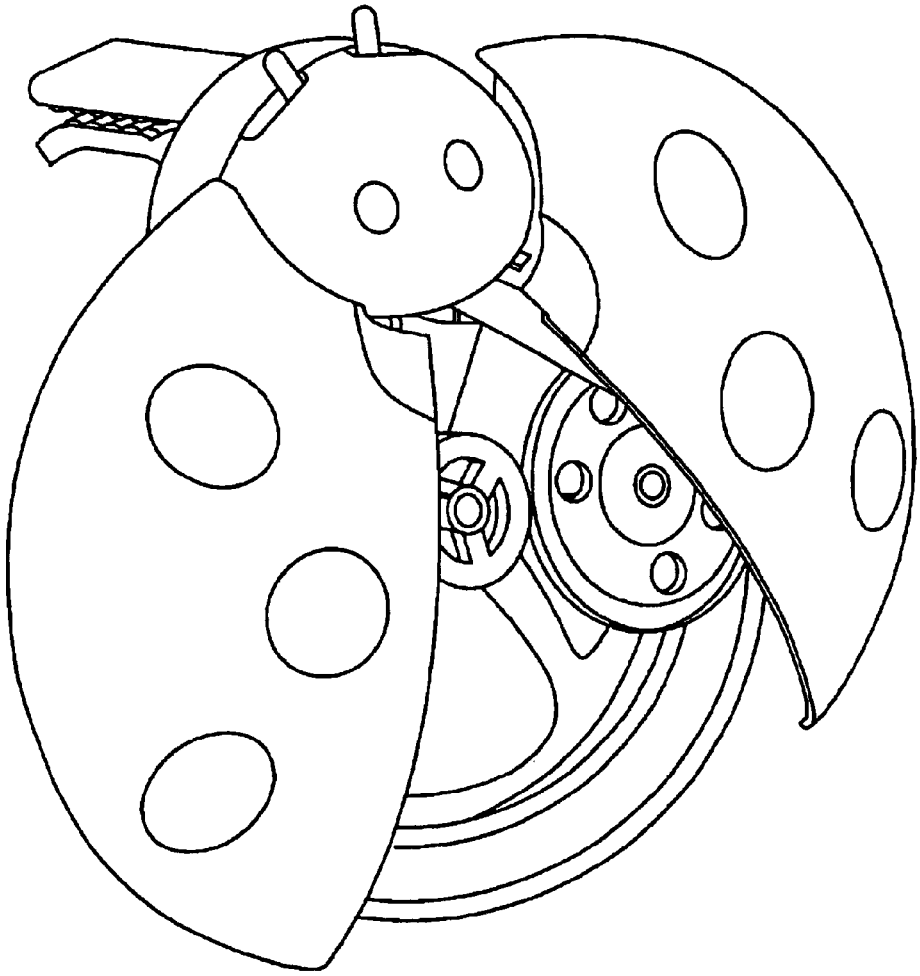
FIG. 7 is front view of the second embodiment.
Figure 8:
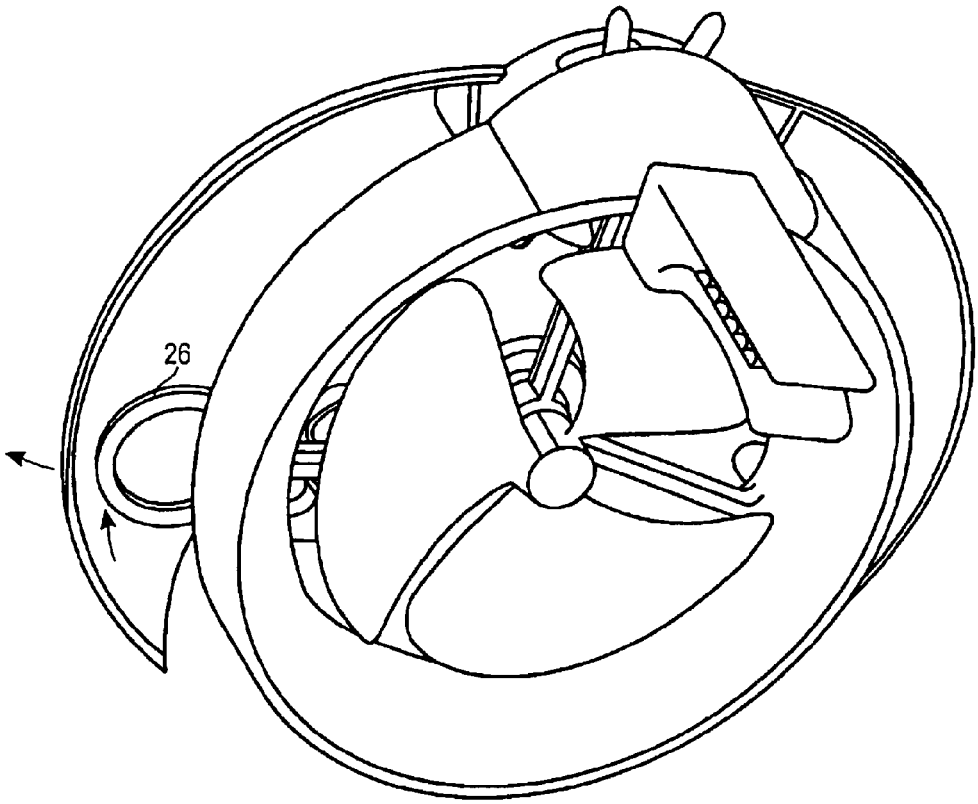
FIG. 8 is rear view of the second embodiment.

This invention comprises a base (21) having at least one rack (27) having an opening such as a boring (28) allowing airflow through said base; two swinging means (22*a*, 22*b*), both having a wheel-shaped connector (30*a*, 30*b*) on the first end of said swinging means (22*a*, 22*b*), connecting with the edge of said base (21), forming a wheel gear (31*a*, 31*b*) respectively, to which two wheel gears connect each other; a fan module (23) attached on that base (21); at least one gear module (20) connecting to an axle (32) of said fan module (21); and a subordinate module, which can be a cam (26) shown in FIG. 5–8, or a shaft (4) shown in FIG. 1–4, connecting said gear module (20) and the second end of one said swinging mean (22*a*, or 22*b*), making said two swinging means (22*a*, 22*b*) pushed and turned mutually, forming open-closed swinging motions.

Said base (21) comprises a rack (27) to connect with said fan module (23), a gear module (20), and at least one boring (28) allowing airflow to blow through outwardly.

The gear module (20) in present invention comprises at least one dish wheel, assembled by a small wheel gears (24) and a big wheel gear (25), making the central stalk bore adjacently connect with the shaft (32) of the fan module (23), making the small wheel gear turning mutually with the fan module. This invention is designed, but not limited the number of the gear wheels used in constructing said gear module (20).

Each swinging means (22*a*, 22*b*) forms, but is not limited to, a hemicycle edged hull body (29*a*, 29*b*) to imitate the wings of ladybugs. Each said swinging means has a wheel-shaped connector (30*a*, 30*b*) on one end connecting with the edge of said base (21), forming a wheel gear (31*a*, 31*b*) respectively, to which two wheel gears of two swinging means connect each other.

The fan module (23) comprises a shaft (32) located on said rack (27) of said base (21), matching said boring (28). Said shaft (32) tightly locks onto the central stalk bore of said small wheel gear (24), making the small wheel gear (24) to turn mutually.

The subordinate module, as a cam located on one of the wheel gear (big wheel gear (25) of the gear module, making the distance from the center of the cam to the edge of the cam shown as a ring (LI), larger than the distance from the inner edge of the swinging means (22*a*) to the center of the wheel gear (L2) (L1>L2). So that when the cam (26) is turned with the wheel gear (25), the outer edge of the cam (26) will push one of the swinging means outward (22*a*) see FIG. 8, making the wheel gear (31*a*) on the connector (30*a*) push and turn the other swinging means (22*b*) respectively. Two swinging means (22*a*, 22*b*) pushed and pulled open and close mutually by the cam (26), simulating the wings of ladybugs.

This invention applies airflow (as the air condition of the car) flowing said fan module (23) to turn said small wheel gear (24) of said gear module (20). Through said small wheel gear (24) to turn said big wheel gear (25), and drive said cam (26) attached by the center of said big wheel gear (25). Said cam (26) pushes said hemicycle edged hull body (29*a*) of one swinging means (22*a*), making said swinging means drive said wheel gear (31*b*) of another swinging means (22*b*) through the movement of said wheel gear (31*a*) of said wheel shaped connector (30*a*). Said two swinging means (22*a*, 22*b*), using its own connector (30*a*, 30*b*) as turning center, open mutually and intermittently. When said cam (26) has no contact with said swinging means (22*a*), said two swinging means (22*a*, 22*b*) close automatically.

Fragrant materials (33) can be applied on the perimeter of that base (21). Fragrance spread indoors through the airflow flowing through said boring (28) on said base (21).

This invention can further include the flexible clip (34), having a plug (35) hooking on the edge of said base (21), for attaching onto desired locations (ex. air vent in the car).

Alternate Embodiment

Said cam (26) of present invention can be, but is not limited to be a half-moon shape.

The cam (26) can be replaced by a driving pole (4) in present invention, making the first end (41) of said driving pole (4) connect to an axle (251) of said big wheel gear (25), as the second end (42) of said driving pole (4) connects to a stinking plug (221) on the connector of one of the swinging means (22*b*). So that when airflow blows on and turns said fan module (23), said shaft (32) of said fan module (23) would turn said big wheel gear (23), driving said driving pole (4) around the axle of said big wheel gear (25). Within one round, the second end (42) of said driving pole (4) pushes outwardly and pulls back inwardly said swinging means (22*b*). Two swinging means (22*a*, 22*b*) swing back and forth, connected by said driving pole (4), simulating the wings of insects or bugs like ladybug.

A Cap (227) holds the two swinging means (22*a*, 22*b*), and connector (30*a*, 30*b*).

Call Out List of Elements (21) Base
(20) Gear Module
(22*a*) Swinging Means
(22*b*) Swinging Means
(221) Stinking Plug
(23) Fan Module
(24) Small Wheel Gear
(25) Big Wheel Gear
(251) Axle
(26) Cam
(27) Rack
(28) Boring
(29*a*) Hemicycle Edge Hull Body
(29*b*) Hemicycle Edge Hull Body
(30*a*) Wheel Shaped Connector
(30*b*) Wheel Shaped Connector
(31*a*) Wheel Gear
(31*b*) Wheel Gear
(32) Shaft
(33) Fragrant Material
(34) The Flexible Clips
(35) Plug
(4) Driving Pole
(41) The First End
(41) The Second End
(227) Cap

What is claimed is:

1. A decorative vent attachment comprising a base having a rack and a boring for airflow to blow through; two semicircle-shaped swinging means each having a hemicycle edge, each swinging means has a wheel-shaped connector adjacently connected to the edge of said base; said connectors each having a wheel gear in which said two wheel gears bite and turn each other respectively to open and close said boring intermittently; a fan module having a shaft mounted on the center of said rack, matching said boring; a small wheel gear attached to said fan module shaft; a big wheel gear attached to said rack mounted deviating from the center of said rack, to bite and turn with said small wheel gear; and a cam adjacently mounted to said big gear wheel, in which the distance from the edge of said cam to the center of said big gear wheel is larger than the distance from the edge of swinging means to the center of said cam, when said swinging means are being closed; allowing airflow to turn said fan module, making said small gear wheel to drive said big wheel gear to turn said cam, wherein said cam intermittently pushes the hemicycle edge of one of said swinging means, to make two swinging means forming an open-closed action.

2. The decorative vent attachment in claim 1, wherein said base has fragrant materials inlaid thereto.

3. The decorative vent attachment in claim 1, further including a flexible clip plugging into the edge of said base.

4. A decorative vent attachment comprising a base having at least a rack and at least one boring for airflow to blow through; two swinging means each has a wheel-shaped connector in first end of said swinging means adjacently connected to the edge of said base; said connectors each forming a wheel gear in which said two wheel gears bite and turn each other respectively; a stinking plug attached to a second end of one said swinging means; a fan module having a shaft mounted on the center of said rack, matching said boring; a gear module having at least one wheel gear having a axle; and a driving pole, in which the first end of said driving pole connects to said axle while the second end of said driving pole connects to said stinking plug, to make two swinging means forming a open-closed action.

5. The decorative vent attachment in claim 4, wherein said gear module has one wheel gear having a shaft attaching said shaft of said fan module and an axle on the surface of said wheel gear connecting with said first end of said driving pole.

6. The decorative vent attachment in claim 4, wherein said gear module comprises a small wheel gear biting with a big wheel gear, making a center bore of said small wheel gear mounted on said shaft of said fan module, while an axle on the surface of said wheel gear connecting with said first end of said driving pole.

7. The decorative vent attachment of claim 4, wherein said base has fragrant materials inlaid thereto.

8. The decorative vent attachment of claim 4, further including a flexible clip plugging into the edge of said base.

9. A decorative vent attachment comprising a base having at least a rack and at least one boring for airflow to blow through; two swinging means each has a wheel-shaped connector in first end of said swinging means adjacently connected to the edge of said base; said connectors each forming a wheel gear in which said two wheel gears bite and turn each other respectively; a fan module mounted on said base; a gear module having at least one wheel gear turning a shaft of said fan module; and a subordinate module in which said subordinate module pushes and turns a second end of one said swinging means to make two swinging means forming a open-closed action.

10. The decorative vent attachment of claim 9, wherein said subordinate module is a cam connected to said wheel gear of said gear module.

11. The decorative vent attachment of claim 9, wherein said subordinate module is a driving pole, in which the first end of said driving pole connects to a axle of said gear module while the second end of said driving pole connects to a stinking plug of one said swinging means, to make two swinging means forming a open-closed action.

12. The decorative vent attachment of claim 9, wherein said base has fragrant materials inlaid thereto.

13. The decorative vent attachment of claim 9, further including a flexible clip plugging into the edge of said base.

* * * * *